US005093015A

United States Patent [19]

Oldiges

[11] Patent Number: 5,093,015

[45] Date of Patent: Mar. 3, 1992

[54] THREAD SEALANT AND ANTI-SEIZE COMPOUND

[75] Inventor: Donald A. Oldiges, Cypress, Tex.

[73] Assignee: Jet-Lube, Inc., Houston, Tex.

[21] Appl. No.: 535,822

[22] Filed: Jun. 11, 1990

[51] Int. Cl.[5] ..... C10M 113/02

[52] U.S. Cl. ..... 252/23; 252/27; 252/29

[58] Field of Search ..... 252/23, 22, 18

[56] References Cited

U.S. PATENT DOCUMENTS

| | | | |
|---|---|---|---|
| 1,586,087 | 5/1926 | Howe et al. | 252/23 |
| 2,419,144 | 4/1947 | Kelly | 252/23 |
| 2,537,629 | 1/1951 | Brown | 252/22 |
| 2,543,741 | 2/1951 | Zweifel . | |
| 2,754,266 | 7/1956 | Stegemeier et al. . | |
| 3,423,315 | 1/1969 | McCarthy et al. . | |
| 3,514,400 | 5/1970 | Hotten | 252/18 |
| 3,652,414 | 3/1972 | Bergeron . | |
| 3,652,415 | 3/1972 | Bergeron . | |
| 3,784,264 | 1/1974 | Jackson, Jr. . | |
| 3,801,506 | 4/1974 | Cross et al. . | |
| 3,843,528 | 10/1974 | Bailey et al. | 252/18 |
| 3,935,114 | 1/1976 | Donaho, Jr. . | |
| 4,155,860 | 5/1979 | Soucy . | |
| 4,358,384 | 11/1982 | Newcomb . | |
| 4,379,062 | 4/1983 | Prengaman . | |

FOREIGN PATENT DOCUMENTS

| | | | |
|---|---|---|---|
| 55-82196 | 6/1980 | Japan | 252/22 |

OTHER PUBLICATIONS

API Bulletin 5A2, Sixth Edition, May 31, 1988, "Bulletin on Thread Compounds for Casing, Tubing, and Line Pipe," issued by American Petroleum Institute.

*Primary Examiner*—Jacqueline Howard
*Attorney, Agent, or Firm*—Arnold, White & Durkee

[57] ABSTRACT

A thread sealant and anti-seize compound is disclosed. The compound includes a thixotropic base material, such as an aluminum complex grease, a boundary lubricant, such as graphite, and a non-metallic flake, such as mica. The compound may further include a metallic flake, such as copper or a copper alloy, an anti-wear additive, such as molybdenum disulfide, and conventional rust, corrosion and oxidation inhibitors.

17 Claims, No Drawings

THREAD SEALANT AND ANTI-SEIZE COMPOUND

BACKGROUND OF THE INVENTION

The present invention relates to thread sealant and anti-seize compounds. The invention has particular application to such compounds as are used to seal and serve as anti-seize compounds for casing, tubing, line pipe, flow lines, subsurface production tools, and tank battery installation, such as those used in oil well drilling operations or in potable water lines.

Oilfield tubing and casing thread forms require products with high film strength and a certain range in coefficient of friction. Because thread faces are often subjected to bearing stresses in excess of 50,000 psi, excessive rotation could result in bearing stresses capable of rupturing the protective film and leading to subsequent galling and damage to the pipe.

Conventionally used thread sealant and anti-seize compounds contain. substantial amounts of lead and zinc. Such substances may present a potential risk to the environment or the health of persons working with such substances. Consequently, there is a need for a high pressure, high temperature resistant sealant and anti-seize compound that is lead and zinc free.

There is a need for such a compound that provides superior film strength and sealant characteristics.

There is a need for such a compound that controls friction in the makeup of casing and tubing, preventing galling and wear, and that ensures proper thread engagement, providing optimum leak resistance.

There is a need for such a compound that may be used to lubricate, seal and protect threaded connections of oilfield tubular goods on makeup, in service and in storage.

The thread sealant and anti-seize compound of the present invention provides such a compound.

SUMMARY OF THE INVENTION

The present invention provides a thread sealant and anti-seize compound, which comprises:

a thixotropic base material;

a boundary lubricant; and a non-metallic flake.

The thread sealant and anti-seize compound of the present invention preferably further comprises a metallic flake and an anti-wear additive.

DETAILED DESCRIPTION OF SPECIFIC EMBODIMENTS

This invention is a thread sealant and anti-seize compound used to seal and serve as an anti-seize compound for casing, tubing, line pipe, flow lines, subsurface production tools, and the like. The compound of the present invention is particularly preferred for use in oil well drilling operations or in potable water lines.

In the thread sealant and anti-seize compound of the present invention, a thixotropic base material is combined with a boundary lubricant and non-metallic flake to generate a compound that is lead and zinc free.

The thixotropic base material includes any material that may be used to uniformly suspend the other components present in the compound of the present invention. The compound of the present invention should provide comparable sealant and film strength results regardless of the thixotropic base material used as the suspending agent for the other components of the composition. Such materials include those conventionally used in thread compounds, for example, inorganic thickening agents, such as silicone base materials, and organic base materials, such as those used in conventional modified compounds. Such organic base materials include hydrocarbon lubricating compound thickeners, which include substances such as soap or complex soap grease. Preferred are the metallic soap or metallic complex soap greases, such as the aluminum complex greases. Aluminum complex greases are particularly preferred as they generally provide a high melting point and excellent inherent water resistance. Such a material should stick to wet steel, ensuring that the compound will not wash off the threads. An aluminum complex grease base is thus excellent for use on connections exposed to high concentrations of moisture. A preferred aluminum complex grease is aluminum benzoate stearate hydroxy complex. Such a complex generally provides excellent heat and water resistance. Alternative metallic soap or metallic complex soap greases that may be used in the thixotropic base material of the compound of the present invention are those including barium, sodium, strontium, calcium or lithium instead of aluminum.

The boundary lubricant included in the thread sealant and anti-seize compound of the present invention may include any boundary lubricant conventionally used in such compounds, including, for example, graphite, calcium carbonate or cerium fluoride.

The non-metallic flake used in the thread sealant and lubricating compound of the present invention may be selected from non-abrasive mineral silicates such as mica, for example.

The thread sealant and anti-seize compound of the present invention preferably further includes a metallic flake and other non-metallic, inorganic, extreme pressure, and anti-wear additives. The metallic flake preferably is copper or a copper alloy, but may include aluminum, antimony, vanadium, tungsten or nickel flake, or any other metallic flake conventionally used for such compounds.

A preferred anti-wear additive is molybdenum disulfide. Alternative anti-wear additives include organo metallic additives, such as antimony dithiocarbamate or bismuth naphthenate. The thread sealant and anti-seize compound of the present invention should provide comparable properties even when the metallic flake is omitted, if the amount of the anti-wear component in the compound is increased. Similarly, the thread sealant and anti-seize compound of the present invention should provide comparable properties even when the anti-wear component is omitted, if the amount of the metallic flake component in the compound is increased. Film strength results, however, should be enhanced by including both an anti-wear component and a metallic flake component in the compound of the present invention.

The thread sealant and anti-seize compound of the present invention may further include conventional rust, corrosion and oxidation inhibitors. Such materials may be blended into the thixotropic base material in the conventional manner. Preferred rust inhibitors include the metallic sulfonates, such as barium sulfonate and calcium sulfonate. Preferred corrosion inhibitors include mercapto diathiazole and benzotriazole. Preferred oxidation inhibitors are conventionally used alkylated diphenylamines.

The thread sealant and anti-seize compound of the present invention may be made using conventional mixing techniques. The components of the compound of the present invention should be sufficiently blended until they obtain a homogeneous mixture. For smaller quantities, blending may take place in a hobart or drum mixer. For larger quantities, the compound of the present invention may be made by combining the compound's components in a grease kettle mixer and mixing them together to produce a homogeneous mixture.

Preferably, to make the compound of the present invention, about 40–80% by weight of the thixotropic base material is mixed with about 5–40% by weight of the boundary lubricant and about 5–20% by weight of the non-metallic flake. In a preferred embodiment of the present invention, about 0.1–8% by weight of the metallic flake and about 0.1–8% by weight of the anti-wear additive is included in the mixture.

In a particularly preferred composition for the thread sealant and anti-seize compound of the present invention, about 43–78% by weight of the thixotropic base material, about 15–30% by weight of the boundary lubricant, about 5–15% by weight of the non-metallic flake, about 1–6% by weight of the metallic flake, and about 1–6% by weight of the anti-wear additive are mixed together under conventional mixing conditions.

Even more preferred are compositions that include about 47–69% by weight of the thixotropic base material, about 18–25% by weight of the boundary lubricant, about 9–13% by weight of the non-metallic flake, about 2–4% by weight of the metallic flake, and about 2–4% by weight of the anti-wear additive, together with minor amounts of rust, corrosion and oxidation inhibitors. Such inhibitors may include between about 0–4% by weight of the rust inhibitor, about 0–2% by weight of the corrosion inhibitor, and about 0–1% by weight of the oxidation inhibitor.

The following examples are illustrative of the present invention. It will be appreciated, of course, that the proportions of components are variable. Selection of different thixotropic base materials, boundary lubricants, non-metallic flakes, metallic flakes, anti-wear additives, rust, corrosion and oxidation inhibitors can readily be made. Compositions may be made that omit the metallic flake, the anti-wear additive and the rust, corrosion and oxidation inhibitors. The examples therefore are not in any way to be construed as limitations upon the scope of the present invention.

| Component | Percentage by weight of total composition |
|---|---|
| thixotropic base material[1] | 57.9 |
| boundary lubricant[2] | 22.4 |
| non-metallic flake[3] | 11.2 |
| metallic flake[4] | 3.1 |
| anti-wear additive[5] | 2.7 |
| rust inhibitor[6] | 2.0 |
| corrosion inhibitor[7] | 0.5 |
| oxidation inhibitor[8] | 0.2 |

[1]Aluminum benzoate stearate hydroxy complex. Jet-Lube, Inc.
[2]Powdered graphite boundary lubricant. Cummings-Moore.
[3]Muscovite mica containing non-metallic flake. Spartan Minerals Corp.
[4]97% purity copper containing metallic flake. U.S. Bronze Powders.
[5]Molybdenum disulfide anti-wear additive. Climax Molybdenum.
[6]Neutral calcium sulfonate rust inhibitor. King Industries.
[7]Mercapto diathiazole corrosion inhibitor. Amoco Chemical Co.
[8]Alkylated diphenylamine oxidation inhibitor. R. T. Vanderbilt Co.

TABLE I lists certain characteristics for the thread sealant and anti-seize compound of EXAMPLE 1.

TABLE I

| | |
|---|---|
| dropping point, Deg °F. (ASTM D566) | 450 min. |
| specific gravity | 1.19 |
| density (lbs/gal) | 9.95 |
| oil separation, wt. % loss at 212° F. | <3.0% |
| flash point (ASTM D-92) | >430° F. |
| water spray off (ASTM D-4049) | <5% |
| NLGI grade | 1 |
| copper strip corrosion (ASTM D-4048) | 1A |
| shell 4-ball EP (ASTM D-2596) | |
| weld point, Kgf minimum | 800 |
| load wear index | 129 |
| penetration | |
| worked at 77° F. | 305 |
| after cooling at 0° F. | 230 min. |
| evaporation, percent 24 hr. at 212° F. | 1.0 max. |
| oil separation, percent 24 hr. at 150° F. | 3.0 max. |
| gas evolution, cc at 150° F., 120 hr. | 0 ccs |
| water leaching, percent wt. loss | 1.0 max. |
| brushability | Pass at 0° F. |

| Component | Percentage by weight of total composition |
|---|---|
| thixotropic base material[1] | 59.9 |
| boundary lubricant[2] | 22.4 |
| non-metallic flake[3] | 11.3 |
| anti-wear additive[4] | 3.7 |
| rust inhibitor[5] | 2.0 |
| corrosion inhibitor[6] | 0.5 |
| oxidation inhibitor[7] | 0.2 |

[1]Aluminum benzoate stearate hydroxy complex. Jet-Lube, Inc.
[2]Powdered graphite boundary lubricant. Cummings-Moore.
[3]Muscovite mica containing non-metallic flake. Spartan Minerals Corp.
[4]Molybdenum disulfide anti-wear additive. Climax Molybdenum.
[5]Neutral calcium sulfonate rust inhibitor. King Industries.
[6]Mercapto diathiazole corrosion inhibitor. Amoco Chemical Co.
[7]Alkylated diphenylamine oxidation inhibitor. R. T. Vanderbilt Co.

TABLE II lists certain characteristics for the thread sealant and anti-seize compound of EXAMPLE 2.

TABLE II

| | |
|---|---|
| dropping point, Deg °F. (ASTM D566) | 450 min. |
| specific gravity | 1.15 |
| density (lbs/gal) | 9.60 |
| oil separation, wt. % loss at 212° F. | <3% |
| flash point (ASTM D-92) | >430° F. |
| water spray off (ASTM D-4049) | <10% |
| NLGI grade | 1 |
| copper strip corrosion (ASTM D-4048) | 1A |
| shell 4-ball EP (ASTM D-2596) | |
| weld point, Kgf minimum | 620 |
| load wear index | 92 |
| penetration | |
| worked at 77° F. | 310–340 |
| after cooling at 0° F. | 200 min. |
| evaporation, percent 24 hr. at 212° F. | 1.0 max. |
| oil separation, percent 24 hr. at 150° F. | 3.0 max. |
| gas evolution, cc at 150° F., 120 hr. | 0 ccs |
| water leaching, percent wt. loss | 1.0 max. |
| brushability | pass at 0° F. |

When compared to the API-MODIFIED thread sealant and anti-seize compound, the compounds of the above examples provide a friction factor of about 1.1. These compositions should stick to wet or oily threads, be brushable over a wide range of temperatures, prevent leakage, and provide a high film strength to protect against wear, galling and seizure.

The thread sealant and anti-seize compounds of the above examples are lead and zinc free. Although the compounds of the above examples do not include any lead or zinc, it would be apparent to those skilled in the art that any composition that includes minor amounts of lead or zinc, but provides essentially the same properties as those of the compounds of the present invention, is within the spirit and scope of the present invention. The present invention thus includes compositions that are substantially free of lead and zinc, as well as those that do not include any lead or zinc. Likewise, although the compounds of the above examples contain additives for rust, corrosion and oxidation protection, compositions that do not include rust, corrosion and oxidation inhibitors, or compositions that omit metallic flake and anti-wear additives, are within the spirit and scope of the disclosed general inventive concept.

Additional advantages and modifications will thus readily occur to those skilled in the art. The invention in its broader aspects is therefore not limited to the specific details and the illustrative examples as shown and described.

What is claimed is:

1. A thread sealant and anti-seize compound comprising:

about 40–80% by weight of a thixotropic base material that is a hydrocarbon lubricating compound thickener;

about 5–40% by weight of a boundary lubricant that is selected from the group consisting of graphite, calcium carbonate, and cerium fluoride; and about 5–20% by weight of a non-metallic flake that is a non-abrasive mineral silicate flake.

2. The thread sealant and anti-seize compound of claim 1 wherein the thixotropic base material is selected from the group consisting of soap and a complex soap grease, the boundary lubricant is graphite, and the non-metallic flake is mica.

3. A thread sealant and anti-seize compound comprising:

a hydrocarbon lubricating compound thickener selected from the group consisting of soap and a complex soap grease;

a boundary lubricant selected from the group consisting of graphite, calcium carbonate and cerium fluoride;

a non-abrasive mineral silicate flake;

a metallic flake; and an anti-wear additive.

4. The thread sealant and anti-seize compound of claim 3 wherein the hydrocarbon lubricating compound thickener is an aluminum complex grease, the boundary lubricant is graphite, the non-abrasive mineral silicate flake is mica, the metallic flake is selected from the group consisting of copper, a copper alloy, nickel and aluminum flake, and the anti-wear additive is selected from the group consisting of molybdenum disulfide, antimony dithiocarbamate and bismuth naphthenate.

5. The thread sealant and anti-seize compound of claim 4 wherein the hydrocarbon lubricating compound thickener is an aluminum benzoate stearate hydroxy complex, the metallic flake comprises copper, and the anti-wear additive comprises molybdenum disulfide.

6. A thread sealant and anti-seize compound comprising:

(a) about 40–80% by weight of a thixotropic base material;

(b) about 5–40% by weight of a boundary lubricant; and (c) about 5–20% by weight of mica flake.

7. The thread sealant and anti-seize compound of claim 6 further comprising about 0.1–8% by weight of a metallic flake.

8. The thread sealant and anti-seize compound of claim 6 further comprising about 0.1–8% by weight of an anti-wear additive.

9. The thread sealant and anti-seize compound of claim 6 wherein the compound comprises:

(a) about 40–80% by weight of the thixotropic base material;

(b) about 5–40% by weight of the boundary lubricant;

(c) about 5–20% by weight of the mica flake; and further comprises:

(d) about 0.1–8% by weight of a metallic flake; and (e) about 0.1–8% by weight of an anti-wear additive.

10. The thread sealant and anti-seize compound of claim 9 wherein the compound comprises:

(a) about 43–78% by weight of the thixotropic base material;

(b) about 15–30% by weight of the boundary lubricant;

(c) about 5–15% by weight of the mica flake;

(d) about 1–6% by weight of the metallic flake; and (e) about 1–6% by weight of the anti-wear additive.

11. The thread sealant and anti-seize compound of claim 10 wherein the compound comprises:

(a) about 47–69% by weight of the thixotropic base material;

(b) about 18–25% by weight of the boundary lubricant;

(c) about 9–13% by weight of the mica flake;

(d) about 2–4% by weight of the metallic flake; and (e) about 2–4% by weight of the anti-wear additive.

12. The thread sealant and anti-seize compound of claim 6 wherein the thixotropic base material is selected from the group consisting of soap and a complex soap grease, and the boundary lubricant is graphite.

13. The thread sealant and anti-seize compound of claim 12 wherein the thixotropic base material is an aluminum complex grease.

14. The thread sealant and anti-seize compound of claim 9 wherein the metallic flake is selected from the group consisting of copper, a copper alloy, nickel and aluminum flake, and the anti-wear additive is selected from the group consisting of molybdenum disulfide, antimony dithiocarbamate and bismuth naphthenate.

15. The thread sealant and anti-seize compound of claim 9 wherein the thixotropic base material is an aluminum complex grease, the boundary lubricant is graphite, the metallic flake comprises copper, and the anti-wear additive comprises molybdenum disulfide.

16. The thread sealant and anti-seize compound of claim 10 wherein the thixotropic base material is an aluminum complex grease, the boundary lubricant is graphite, the metallic flake comprises copper, and the anti-wear additive comprises molybdenum disulfide.

17. The thread sealant and anti-seize compound of claim 11 wherein the thixotropic base material is an aluminum complex grease, the boundary lubricant is graphite, the metallic flake comprises copper, and the anti-wear additive comprises molybdenum disulfide.

* * * * *